US005800052A

United States Patent [19]

Yeh

[11] Patent Number: 5,800,052

[45] Date of Patent: Sep. 1, 1998

[54] FLOOR LAMP SAFETY SHIELD AND SWITCH

[76] Inventor: John Yeh, 660 S. Aberdeen, Anaheim Hills, Calif. 92807

[21] Appl. No.: 762,337

[22] Filed: Dec. 9, 1996

[51] Int. Cl.[6] ..... F21V 15/00

[52] U.S. Cl. ..... 362/376; 362/276; 362/265; 362/395; 362/414; 362/411; 362/802

[58] Field of Search ..... 362/276, 376, 362/394, 395, 410, 411, 414, 431, 802, 263, 265, 354; D26/119

[56] References Cited

U.S. PATENT DOCUMENTS

| | | | |
|---|---|---|---|
| 5,073,846 | 12/1991 | Lin | 362/263 |
| 5,221,141 | 6/1993 | Swanson | 362/250 |
| 5,452,192 | 9/1995 | Yurich | 362/346 |

*Primary Examiner*—Stephen F. Husar

*Attorney, Agent, or Firm*—Francis X. LoJacono; Peter Jon Gluck; Patent Law Firm

[57] ABSTRACT

The present invention relates to a safety shield or protective cover for halogen lamps, particularly halogen floor lamps, whereby the protective safety shield is mounted over the enlarged opening of the inverted shade device so that flammable objects are prevented from coming in contact with a very hot lighted halogen bulb. The safety shield comprises a plurality of ring members that are equally spaced apart, one above the other, and a fixedly attached to strut members, and wherein the halogen lamp is provided with a safety switch that is arranged to allow for an operative active mode as long as the lamppost is in a vertical position, and conversely placed in an operative mode when the lamp is tilted to at least 10° in any direction about the vertical axis of the lamp.

36 Claims, 4 Drawing Sheets

FLOOR LAMP SAFETY SHIELD AND SWITCH

BACKGROUND OF THE INVENTION

1. Field of the Invention

The present invention relates generally to a floor lamp and more particularly to a floor lamp having a protective safety shield mounted over the opened shade device and a safety switch, whereby flammable articles are prevented from coming in contact with a very hot lighted bulb.

2. Description of the Prior Art

As is well known in the art of lamps there are many types and designs, including the more recently introduced lamp which employs a halogen lamp bulb. Halogen lamp bulbs are generally used with the common household electrical 110–130 V systems. However, these bulbs are provided with very high wattage of from 100 W up to 500 W which can reach temperatures well over 350°. Therefore, these high watt rated bulbs on occasions have accidentally come in contact with flammable articles such as paper products, cloth material, etc.

Accordingly, accidental contacts with these very hot lamp bulbs can cause almost an instant flash fire. Thus, a halogen floor lamp that has a typical large diameter bowl-like shade device, hereinafter referred to as an inverted shade, in which the halogen bulb is exposed on the top can readily come in contact with loose articles such as decorative household freely hung draperies and the like. Accidents have occurred when drapes are windblown so as to come in direct contact with the lamp light fixture. Other types of accidents have been known to cause serious problems such as when a lighted halogen floor lamp or even an open table halogen lamp is inadvertently knocked over and falls on a chair, bed, or other flammable furnishing commonly found in homes or offices.

Since halogen lamps have just recently become very popular such problems as mentioned above have become more frequently known. Thus, there is an urgent need to find a device of allowing halogen lamps to be provided with simple means to prevent the above mentioned problems and other similar or related serious accidents from happening without affecting the unique lighting ability, the simplicity of the lamp, and the lamps aesthetic value.

SUMMARY AND OBJECTS OF THE INVENTION

The present invention comprises a floor lamp having very high wattage lamp bulbs mounted thereon and more particularly to floor lamps that are referred to as halogen lamps which include the use of very high wattage halogen lamp bulbs. These bulbs are generally mounted at the top of a floor lamp and are centrally positioned in a shade device which has the appearance of a large diameter bowl. The halogen bulb in removably mounted horizontally in a socket fitting or cradle and is covered with a small elongated glass screen. When the bulb is lighted it becomes very hot in a short time. Because of the heat generated by the halogen lamp bulb it cannot be placed too close to a wall or furniture as mentioned above.

Since a bowl-like shade is used, it is generally formed from a sheet metal or from a glass product shaped in a shallow-bowl configuration having an enlarged annular peripheral edge to which a protective safety shield is mounted. The shield can be provided with many different configurations which are arranged to be removably secured about the peripheral edge of the shade. Preferably, the safety shield is formed from a heavy wire structure having a suitable configuration so as not to interfere with the radiating light and heat that is generated by the halogen lamp bulb. The details of the particular wire structures and securing means will hereinafter be described in detail, along with a safety switch which will automatically cause the floor lamp to be turned off if it is accidentally tipped more than 10° in any direction about the central axis of the post of the lamp.

Accordingly, it is an important object of the present invention to provide a floor lamp and particularly a halogen floor lamp with a protective shield, whereby articles or materials of any kind are prevented from entering the approximate area of the surrounding bowl-like shade (inverted shade) in which the halogen lamp bulb is positioned.

Another object of the present invention is to provide a protective safety shield that comprises a wire structure formed in a dome-like configuration that prevents foreign objects from entering the inner perimeter of the lamp shade bowl so as to prevent any contact between an outside object and the halogen bulb.

Still another object of the present invention is to provide a floor lamp of this character, wherein the base of the lamppost is provided with a safety switch arranged to be in an automatically activated mode when the floor lamp is in a true vertical position and is automatically placed in an inactive mode whenever the floor lamp is inadvertently moved or tipped or tilted more than 10° from the central axis of the lamppost. That is, the safety switch defines a secondary switch means that is in a normally close mode when the lamp is in a vertical position when the switch is engaging the floor, and is automatically placed in an open nonoperating mode when the switch is tilted so as to disengage the switch from the floor. This then allows the hot halogen lamp bulb to be turned off before it contacts an adjacent object, thereby preventing a flash fire.

A further object of the invention is to provide a halogen floor lamp wherein the safety shield is provided with a suitable means for removably affixing the shield within the shallow lamp shade.

Still another object of the present invention is provide a halogen lamp fixture of this character that is simple in its structure and rugged in construction, as well as being inexpensive to manufacture, and yet pleasing in the overall design of the floor lamp structure.

The characteristics and advantages of the invention are further sufficiently referred to in connection with the accompanying drawings, which represents one or more embodiments. After considering these examples, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

The objects and features of the present invention will be further understood with reference to the following detailed description of the illustrated embodiment of the invention, taken together with the accompanying drawings in which.

DESCRIPTION OF THE PREFERRED EMBODIMENTS

Figure 1:
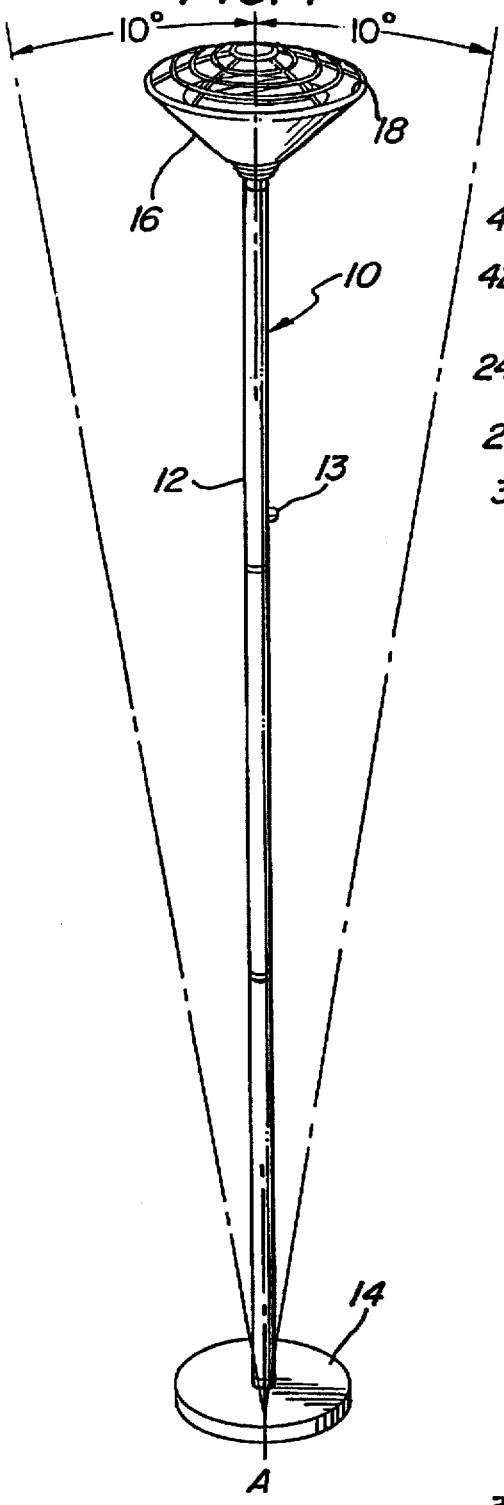
FIG. 1 is a pictorial view of the present invention illustrating one embodiment of a safety shield mounted on a floor lamp and more particularly a halogen lamp.
Figure 2:
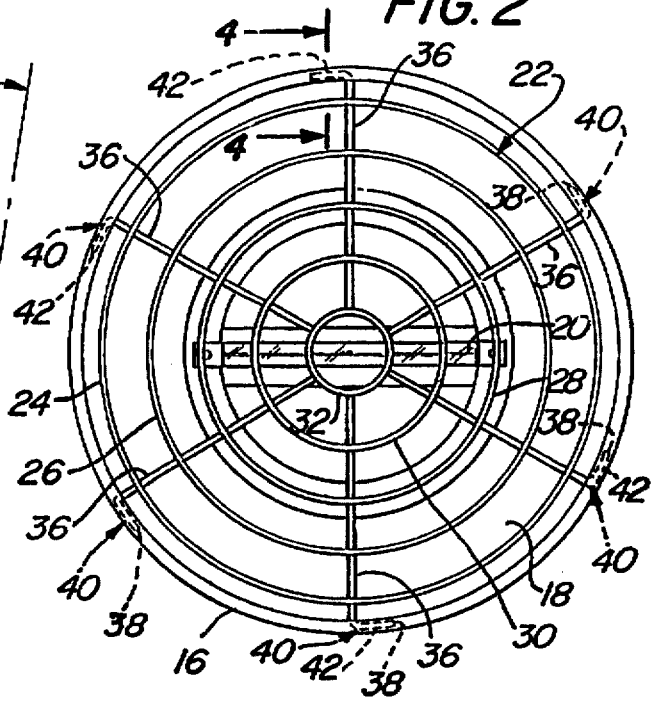
FIG. 2 is a top plan view thereof.
Figure 3:
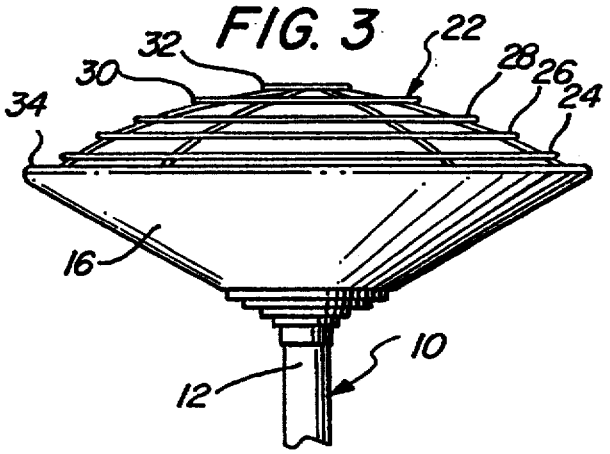
FIG. 3 is a side-elevational view of the safety shield mounted to the bowl-like inverted shade.

Referring now in more detail to FIGS. 1 through 4, there is shown in FIG. 1, a halogen floor lamp, generally indicated at 10, which comprises a lamppost 12 having a variable switch means 13. The lamppost 12 is fixedly mounted at its lower end to a base member 14. A lamp cover or an inverted shade 16 is mounted to the upper end of the lamppost 12 and includes an inner reflecting surface 18 that reflects light from a suitable halogen lamp bulb 20, as illustrated in FIG. 2. Halogen bulbs can range between 100 w to 500 w, providing an intense bright light when lit which radiates an extreme degree of heat that can inadvertently cause a flash fire when a flammable material comes in contact with a lighted halogen bulb.

Accordingly, the present invention defines a safety shield, generally indicated at 22, that prevents flammable materials from coming in contact with such materials and/or articles. The lamp shield is adapted to be removably attached within the lamp cover or inverted shade 16, so as to provide a protective cover or dome over lamp bulb 20. This prevents bulb 20 from coming in contact with foreign objects or articles that might inadvertently enter the inverted shade 16, making it particularly hazardous when the halogen lamp bulb is lit.

The various embodiments of the safety shield as herein disclosed are provided with at least 2 or more wire ring members. Thus, in FIGS. 1, 2 and 3, there is illustrated a plurality of wire ring members which are indicated at 24, 26, 28, 30 and 32. These wire ring members are equally spaced apart, one above the other, with each having a progressively reduced diameter so that the lowermost or first ring member 24 has the largest diameter and is positioned adjacent the outer free peripheral edge 34 of inverted shade 16. The uppermost or second ring member 32 is provided with the smallest diameter. Each ring member 24 through 32 is fixedly secured by suitable means to a plurality of strut members 36 that are equally spaced apart and radially disposed from each other, whereby safety shield 22 is divided into protective pie-shaped segments. The sizes of the segments depend on the number of strut members that are used in constructing the shield.

Figure 4:
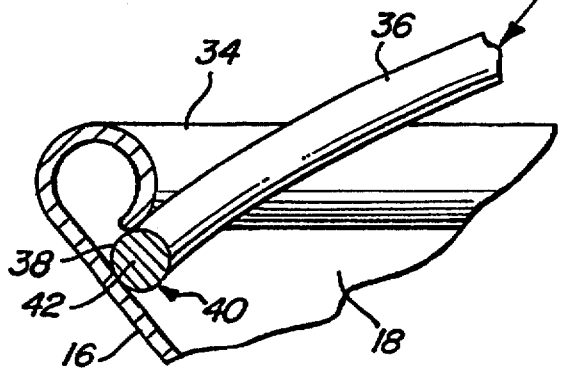
FIG. 4 is an enlarged cross-sectional view taking substantially along line 4—4 of FIG. 2 showing one portion of the safety shield secured under the peripheral edge of the shade.
Figure 5:
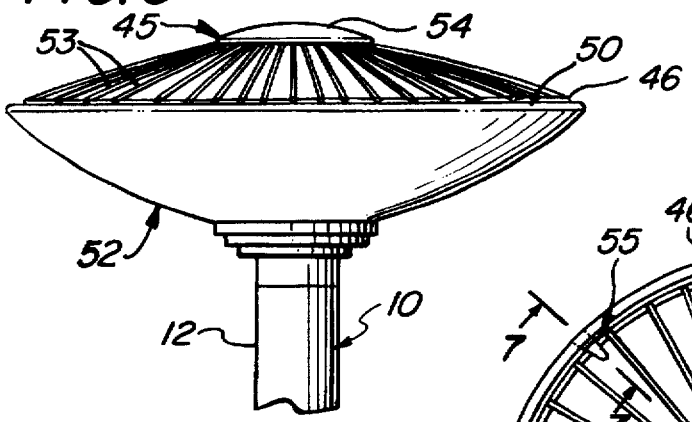
FIG. 5 is a side-elevational view of a second embodiment of the safety shield mounted to a shade fixture.
Figure 6:
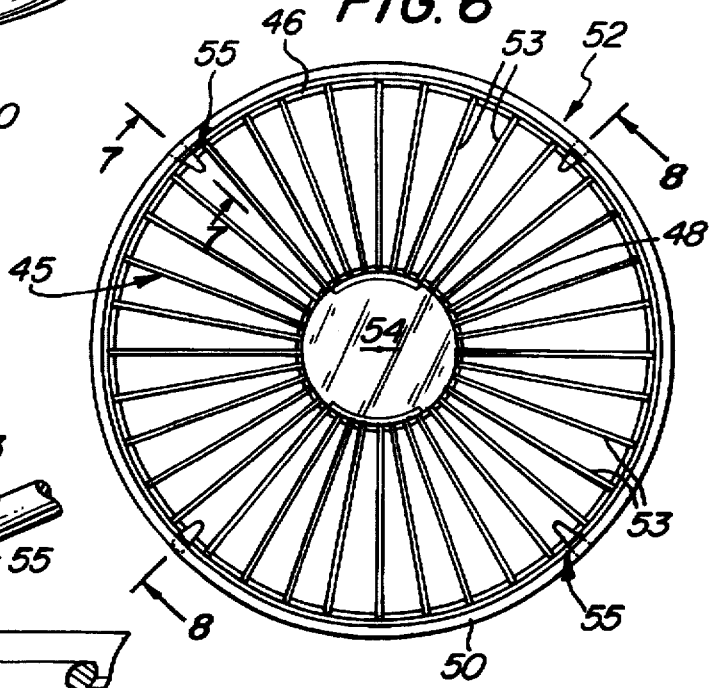
FIG. 6 is a top plan view thereof.

Each strut member 36 is provided with a suitable length, whereby the outer extended free end 38 thereof is formed with a securing means, designated at 40, defined by an inwardly bent leg member 42 arranged for engagement with the free peripheral edge 34 which is formed with a rounded and substantially C-shaped configuration, as illustrated in the enlarged cross-sectional view of FIG. 4. The upper end 44 of each strut member terminates at the smallest diameter ring member 32 by being fixedly secured thereto.

Referring now to the embodiment as illustrated in FIGS. 5, 6, 7 and 8, there is shown a safety shield, indicated generally at 45, which comprises a first wire ring member 46 and a second wire ring member 48, the first and largest ring member 46 being positioned adjacent the outer free peripheral edge 50 of inverted shade member 52, and the second smallest ring member being positioned centrally above the inverted shade member 52. A plurality of strut members 53 are arranged to be suitably attached at their opposite ends to the respective ring members 46 and 48. The smaller diameter ring member 48 is adapted to receive and support a cap member 54 made of suitable material, preferably glass.

Figure 7:
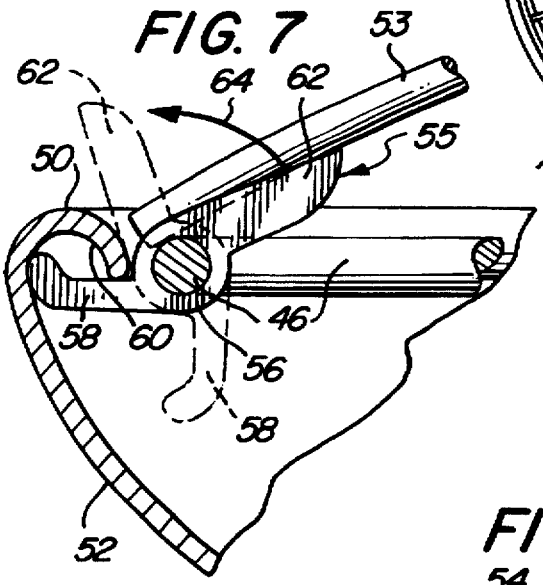
FIG. 7 is an enlarged cross-sectional view taken substantially along line 7—7 of FIG. 6 showing one portion of the safety shield secured under the peripheral edge of the shade.
Figure 8:
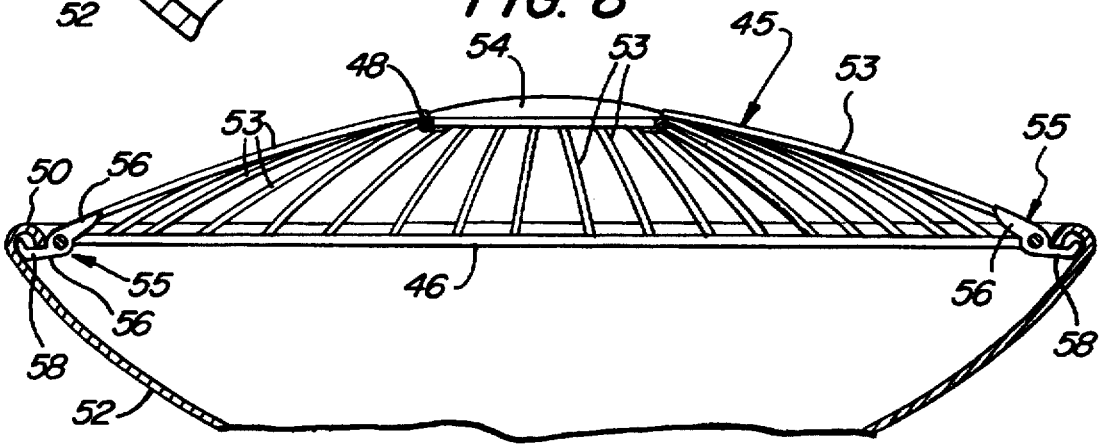
FIG. 8 is an enlarged cross-sectional view taken substantially along line 8—8 of FIG. 6

A securing means, indicated at 55, which is defined by a keeper member 56 is rotatably mounted on ring member 46, as illustrated in the enlarged cross-sectional view of FIG. 7. Keeper member 56 is formed having latch member 58 adapted to be received in the annular channel 60 defined by the peripheral edge 50 and includes an arm member 62 that allows the keeper member to rotate between a latched position to a free position, as indicated by phantom line and arrow 64.

Figure 9:
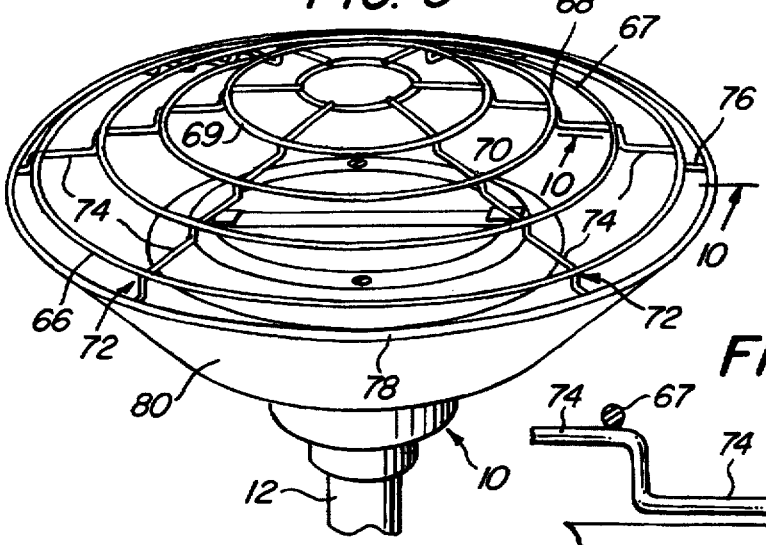
FIG. 9 is a pictorial view of another embodiment of the present invention affixed to a halogen lamp shade.
Figure 10:
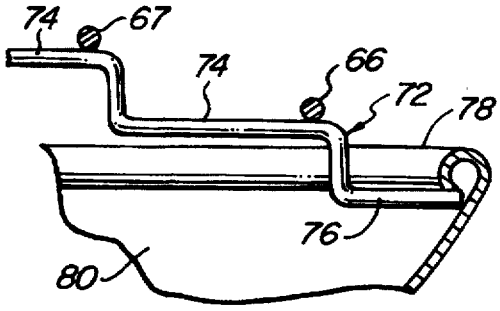
FIG. 10 is an enlarged cross-sectional view taken substantially along line 10—10 of FIG. 9.

Another embodiment is illustrated in FIGS. 9 and 10, wherein the safety shield is indicated generally at 65, which comprises a plurality of ring members 66, 67, 68, 69 and 70. The lowest positioned ring member 66 is formed with the largest diameter, and ring member 70 is formed with the smallest diameter. Each ring member is fixedly secured to a plurality of strut members 72 that are formed to define offset step members 74 which support the respective ring members, as illustrated in the enlarged cross-sectional view of FIG. 10. The lowermost step 76 defines a securing means that mounts under the annular upper edge 78 of the inverted shade 80.

Figure 11:
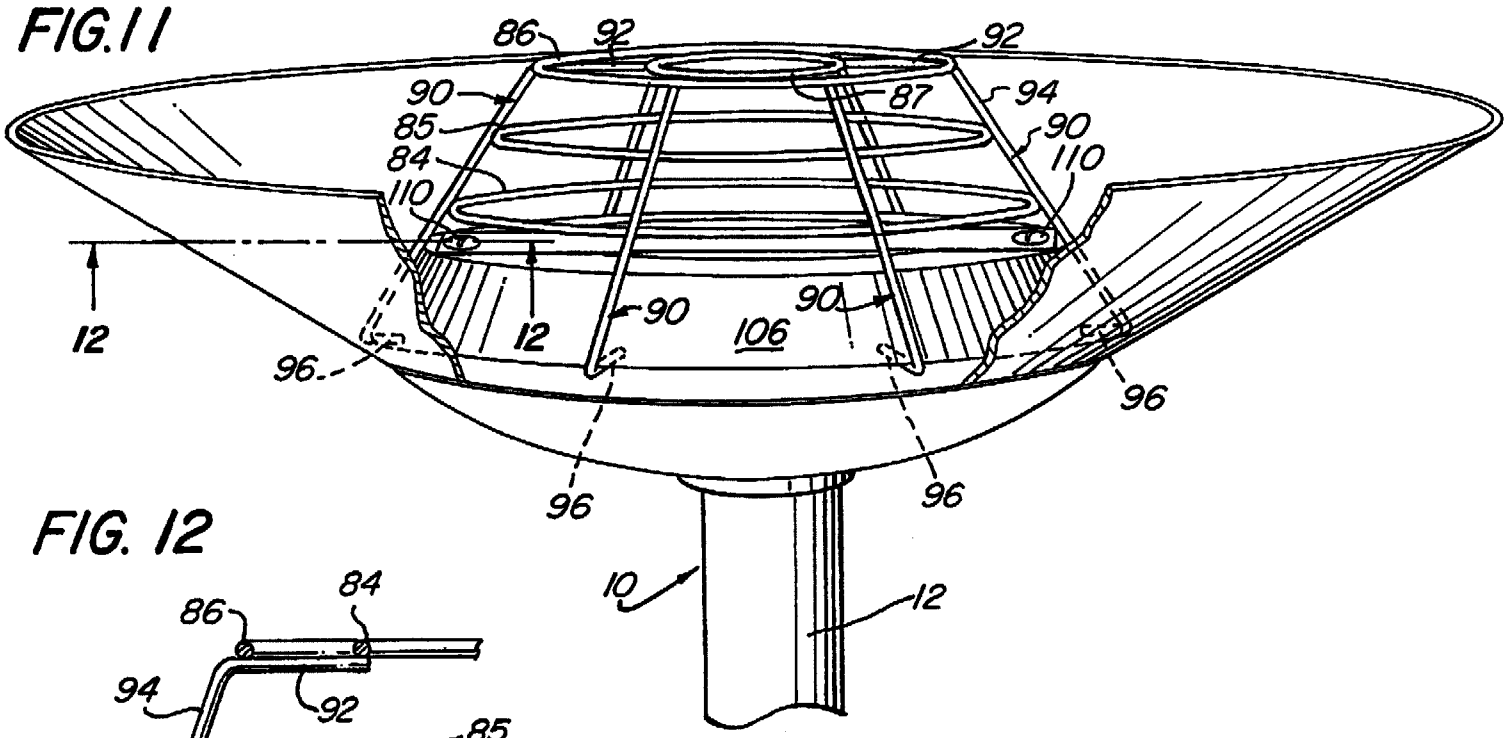
FIG. 11 is an enlarged view of another embodiment of the present invention fixedly mounted to a halogen support frame member by means of a circular cover member and wherein a portion of the shade is broken away.
Figure 12:
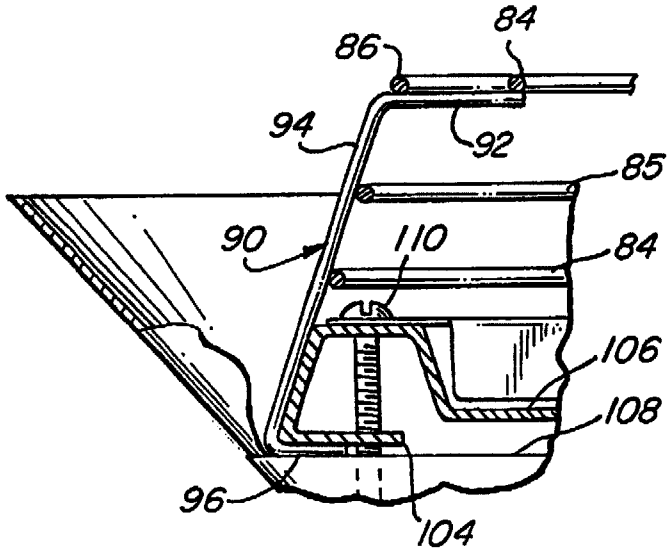
FIG. 12 is an enlarged cross-sectional view taken substantially along line 12—12 of FIG. 11.

The last embodiment of the present invention discloses a safety shield, as illustrated in FIGS. 11 and 12 and generally designated at 82, which comprises a plurality of progressively reduced diameter ring members 84, 85, 86 and 87 that are fixedly secured to a plurality of equally spaced apart strut members 90. Each strut member is formed with an upper support arm 92, an intermediate strut portion 94, and a lower footing member 96. The upper arm 92 is bent inwardly of the intermediate strut portion 94, whereby the upper support arm 92 is formed to support ring members 86 and 87. The lower footing member 96 is also bent inwardly of the intermediate strut portion 94, whereby footing member 96 establishes a part of a securing means 100 for the safety shield when mounted in an inverted shade 102 that does not have a suitable annular rim or edge such as described above with respect to inverted shades 16, 52 and 80. Accordingly, each footing member 98 is positioned under a flange member 104 formed on the bottom of a halogen reflector device 106 held in place by screws 105. The reflector device is secured to halogen lamp bulb receptacle 108 by means of screws 110.

Ring members 84 and 85 are fixedly attached to the respective intermediate strut portions 94. The structural arrangement of this embodiment and the other described embodiments provide protection that has not heretofore been possible and further allows air to freely circulate within the heated bowl-like inverted shade.

Figure 14:
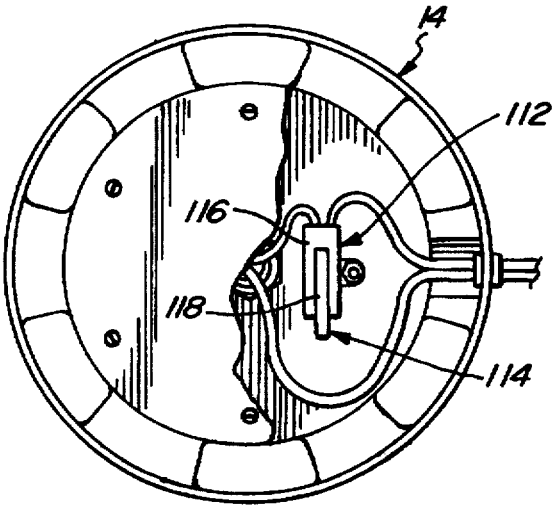
FIG. 14 is a bottom plan view of the base member with a portion thereof broken away to show the position of the switch member.
Figure 13:
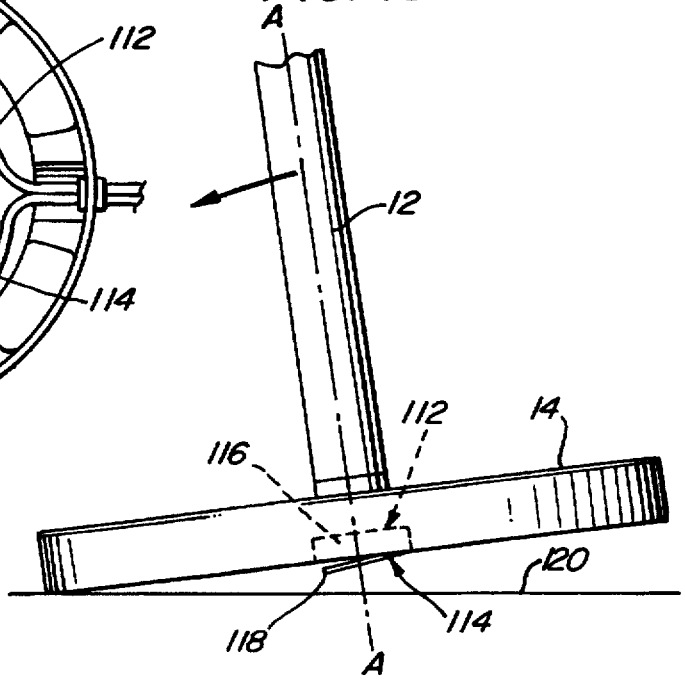
FIG. 13 is a view of the base member supporting the lamppost and illustrating the post and base member tilted so that the switch member is placed in an open inactive mode.

Referring more particularly now to FIGS. 13 and 14, there is disclosed a safety switch means, generally indicated at 112, that is mounted within the base member 14 so as to break or open the electric circuit of the lamp when the lamppost 12 is inadvertently tilted more than 10° in any direction from its central axis A—A, as illustrated in FIGS. 1 and 13, or when knocked over. Together with the typical lamp switch, indicated at 13 in FIG. 1, the safety switch means 112 includes an adjustable automatic switching means 114, which is shown as an arm member 118, so as to provide a closed operating circuit when the lamppost 12 is in a vertical position and to an open inoperative circuit when lamppost 12 is tilted at least 10° or more in any direction about its central axis A—A, whereby the halogen lamp bulb 20 is turned off.

The automatic safety switch means 112 can be suitably provided by a micro switch 116 that includes adjustable switch arm 118, as seen in FIGS. 13 and 14, wherein the micro switch 116 is mounted in the heavy metal base 14 so that switch arm 118 extends downwardly to engage floor 120.

Due to the intense heat that is generated by halogen bulbs and other structural characteristics of halogen lamps they can sometimes fall on rugs, soft furniture or flammable objects in a room yet allow the bulbs to remain fully operational, so that fires can be accidentally started by igniting the furnishings.

Thus, the foregoing should only be considered as illustrative of the principles of the invention. Further, since numerous modifications and changes may readily occur to those skilled in the art, it is not desired to limit the invention to the exact construction and operation as shown and described and, accordingly, all suitable modifications and equivalents may be resorted to, falling within the scope of the claimed invention.

What I claim is:

1. In combination, a protective safety shield for attaching to a floor lamp inverted shade which defines an opening in which is disposed a lamp bulb that generates an intense heat when lit and is covered by said protective safety shield, which comprises:

a plurality of wire ring members having at least a lowermost wire ring member formed with a diameter equal to or less than the diameter of the opening defined by an inverted shade; and at least an uppermost wire ring member formed with a diameter less than the diameter of said lowermost wire ring member and positioned above said lowermost wire ring member;

a plurality of strut members fixedly attached between said uppermost and lowermost wire ring members;

means formed with said protective safety shield for securing said safety shield to said inverted shade.

2. The protective safety shield as recited in claim 1, including a cap member mounted in said uppermost wire ring member.

3. The protective safety shield as recited in claim 1, wherein said safety shield includes a plurality of spaced-apart wire ring members interposed between said uppermost and lowermost wire ring members.

4. The protective safety shield as recited in claim 3, wherein said interposed wire ring members are formed having progressively reduced diameters with respect to that of said lowermost ring member.

5. The protective safety shield as recited in claim 4, wherein said strut members are equally spaced apart and radially disposed from each other, whereby said protective safety shield is divided into protective segments.

6. The protective safety shield as recited in claim 5, wherein said securing means is defined by an outer extended free end of each of said strut members, wherein said free end is formed having a leg member arranged for engagement with said inverted shade.

7. The protective safety shield as recited in claim 6, wherein said strut members are formed with a plurality of offset step members arranged to support respective wire ring members, one above the other.

8. The protective safety shield as recited in claim 7, wherein said securing means is defined by a lowermost extended step member for engagement with said inverted shade.

9. The protective safety shield as recited in claim 5, wherein said securing means is defined by the outer extended free end of each of said strut members, wherein said free end is formed having a leg member arranged for engagement with said inverted shade.

10. The protective safety shield as recited in claim 2, wherein said securing means is defined by a plurality of keeper members which are rotatably mounted on said lowermost wire ring member for engagement with said inverted shade member.

11. The protective safety shield as recited in claim 10, wherein each of said keeper members is formed having a latch member arranged to be received in an annular channel formed in said inverted shade, and an arm member that allows said keeper member to rotate between a latched position and a released position.

12. The protective safety shield as recited in claim 1, wherein each of said strut members is formed with an upper support arm, an intermediate strut portion, and a lower footing member, whereby said support arm is positioned to support ring members thereon, and wherein said lower footing member is positioned to be attached within said inverted shade.

13. The protective safety shield as recited in claim 12, wherein said footing member defines said securing means.

14. In combination, a safety shield for attaching to a halogen floor lamp having an inverted shade which defines an opening in which is disposed a halogen lamp bulb that generates an intense heat when lit and is covered by said safety shield, said combination comprising:

a halogen floor lamp including an inverted shade mounted at the top of a lamppost and having a variable switch control means;

a base member on which is mounted said lamppost;

a halogen lamp bulb operably mounted within said inverted shade;

a safety shield comprising a plurality of ring members having at least a lowermost ring member formed with a diameter equal to or less than the opening defined by said inverted shade, and at least an uppermost ring member formed with a diameter less than the diameter of said lowermost ring member and positioned above said uppermost ring member;

a plurality of strut members fixedly attached between said uppermost and lowermost ring members;

means formed with said protective safety shield for securing said safety shield to said inverted shade over said opening thereof to prevent foreign objects from entering therein.

15. The combination as recited in claim 14, including a cap member mounted in said uppermost wire ring member.

16. The combination as recited in claim 14, wherein said safety shield includes a plurality spaced-apart ring members interposed between said uppermost and lowermost ring members.

17. The combination as recited in claim 16, wherein said interposed ring members are formed having progressively reduced diameters with respect to that of said lowermost ring member.

18. The combination as recited in claim 17, wherein said strut members are equally spaced apart and radially disposed from each other, whereby said protective safety shield is divided into a plurality of protective segments.

19. The combination as recited in claim 18, wherein said securing means is defined by an outer extended free end of each of said strut members, and wherein said free end is formed having a leg member arranged for engagement with said inverted shade.

20. The combination as recited in claim 19, wherein said strut members are formed with a plurality of offset step members arranged to support respective ring members, one above the other.

21. The combination as recited in claim 20, wherein said securing means is defined by a lowermost extended step member for engagement with said inverted shade.

22. The combination as recited in claim 18, wherein said securing means is defined by an outer extended free end of each of said strut members, and wherein said free end is formed having a leg member arranged for engagement with said inverted shade.

23. The combination as recited in claim 18, wherein said securing means is defined by a plurality of keeper members which are rotatably mounted on said lowermost wire ring member for engagement with said inverted shade member.

24. The combination as recited in claim 23, wherein each of said keeper members is formed with a latch member arranged to be received in an annular channel formed in said inverted shade and an arm member that allows said keeper member to rotate between a latched position and a released position.

25. The combination as recited in claim 14, wherein each of said strut members is formed with an upper support arm, an intermediate strut portion, and a lower footing member, whereby said upper support arm is positioned to support said ring members thereon, and wherein said lower footing member is positioned to be attached within said inverted shade.

26. The combination as recited in claim 25, wherein said footing member defines said securing means.

27. The combination as recited in claim 14, wherein said halogen floor lamp includes a safety switch means which is positioned to deactivate said halogen lamp bulb when said halogen floor lamp is moved from a vertical standing position.

28. The combination as recited in claim 27, wherein said safety switch is positioned in said base of said halogen floor lamp, and wherein said safety switch means automatically deactivates said halogen lamp bulb when said floor lamp is angularly tilted in any direct about its vertical axis.

29. The combination as recited kin claim 27, wherein said safety switch is positioned in said base of said halogen floor lamp, and wherein said safety switch means automatically deactivates said halogen lamp bulb when said floor lamp is angularly tilted at least 10° in any direction from the vertical central axis of said lamppost.

30. A halogen floor lamp comprising:

a base member;

a lamppost mounted to said base member;

an inverted reflective lamp shade mounted at the uppermost end of said lamppost which includes a halogen lamp bulb;

a safety shield mounted over said inverted reflective lamp shade so as to protect said halogen lamp bulb by preventing objects from falling into said lamp shade;

a primary switch mounted to said floor lamp; and a secondary switch mounted to the underside of said base member and arranged to be in an activated mode when said primary switch is in an "on" mode and said floor lamp is in a vertical operating position, and arranged to be in an inactivated position when said floor lamp is angularly tilted in any direction about its vertical axis.

31. The halogen floor lamp as recited in claim 30, wherein said secondary switch is arranged to be in an inactivated position when said floor lamp is angularly positioned at least 10° in any direction from the vertical central axis of said floor lamp.

32. The halogen floor lamp as recited in claim 31, wherein said safety shield comprises:

a plurality of ring members having at least a lowermost ring member formed with a diameter equal to or less than the opening defined by said inverted shade, and at least an uppermost ring member formed with a diameter less than the diameter of said lowermost ring member and positioned above said lowermost ring member;

a plurality of strut members fixedly attached between said uppermost and lowermost ring members;

means formed with said protective safety shield for securing said safety shield to said inverted shade over said opening thereof to prevent foreign objects from entering therein.

33. The halogen floor lamp as recited in claim 32, including a cap member mounted in said uppermost ring member.

34. The halogen floor lamp as recited in claim 32, wherein said safety shield includes a plurality spaced-apart ring members interposed between said uppermost and lowermost ring members.

35. The halogen floor lamp as recited in claim 34, wherein said interposed ring members are formed having progressively reduced diameters with respect to that of said lowermost ring member.

36. The halogen floor lamp as recited in claim 35, wherein said strut members are equally spaced apart and radially disposed from each other, whereby said protective safety shield is divided into a plurality of protective segments.

* * * * *